United States Patent [19]

Bourdon et al.

[11] 4,082,398

[45] Apr. 4, 1978

[54] ELECTRICAL CONNECTOR WITH FRONT AND REAR INSERTABLE AND REMOVABLE CONTACTS

[75] Inventors: Normand C. Bourdon; Richard Sanford, both of Sidney, N.Y.; Raymond J. Eifler, Farmington, Mich.

[73] Assignee: The Bendix Corporation, Southfield, Mich.

[21] Appl. No.: 728,820

[22] Filed: Oct. 1, 1976

[51] Int. Cl.[2] ..... H01R 9/16

[52] U.S. Cl. ..... 339/59 M; 339/217 S

[58] Field of Search ..... 339/59, 62, 63, 217 S

[56] References Cited

U.S. PATENT DOCUMENTS

| | | | |
|---|---|---|---|
| 3,165,369 | 1/1965 | Maston | 339/59 M |
| 3,227,172 | 4/1973 | Clark | 339/59 M |
| 3,383,642 | 5/1968 | Nava | 339/217 S |
| 3,648,213 | 3/1972 | Kobler | 339/217 S |

FOREIGN PATENT DOCUMENTS

| | | | |
|---|---|---|---|
| 2,020,077 | 11/1971 | Germany | 339/217 S |

*Primary Examiner*—Roy Lake
*Assistant Examiner*—E. F. Desmond
*Attorney, Agent, or Firm*—R. J. Eifler; K. A. Seaman

[57] ABSTRACT

A dielectric insert for retaining a plurality of electrical contacts in an electrical connector. The insert (10) includes passages (15) having therein opposing radially deflectable contact retaining fingers (11) integral with the insert (10). The free ends (12) of the retention fingers (11) face each other, thereby defining a cavity for captivating the enlarged portion (25) of a contact. The radially deflectable fingers (11) allow a contact to be inserted and removed from either end of an electrical connector (1).

12 Claims, 24 Drawing Figures

FIG. 1
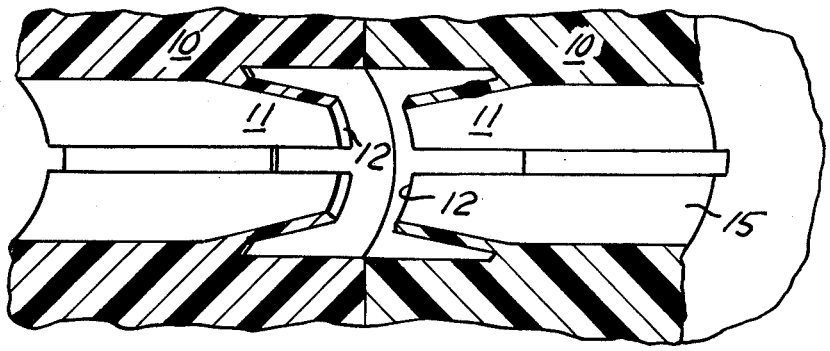
FIG. 3
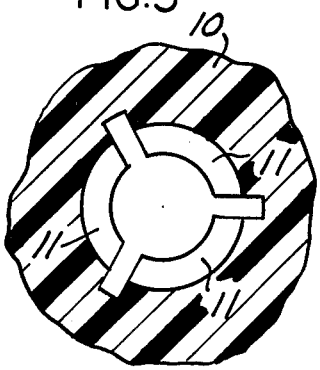
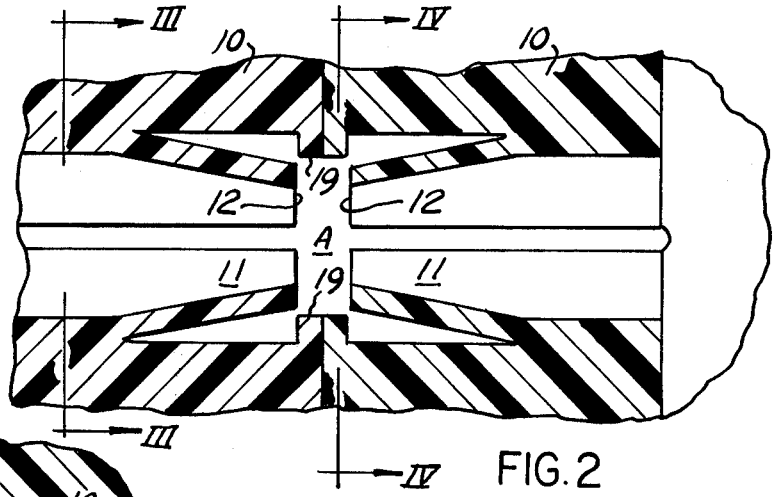
FIG. 2
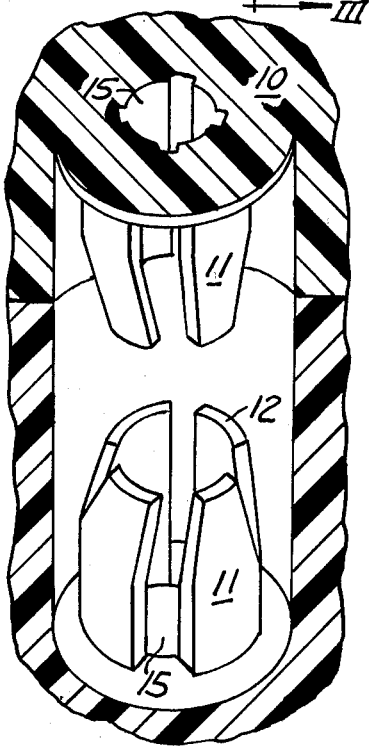
FIG. 5
FIG. 4
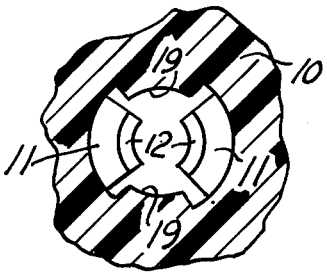

FIG. 10
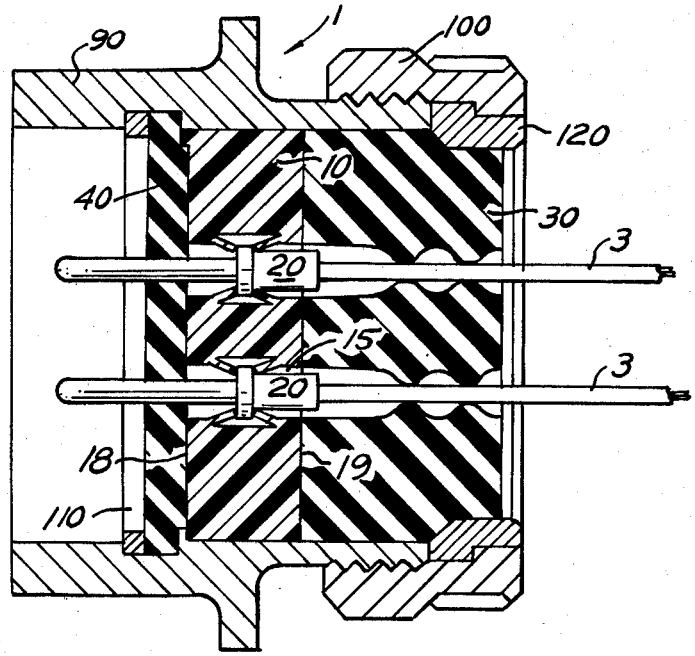
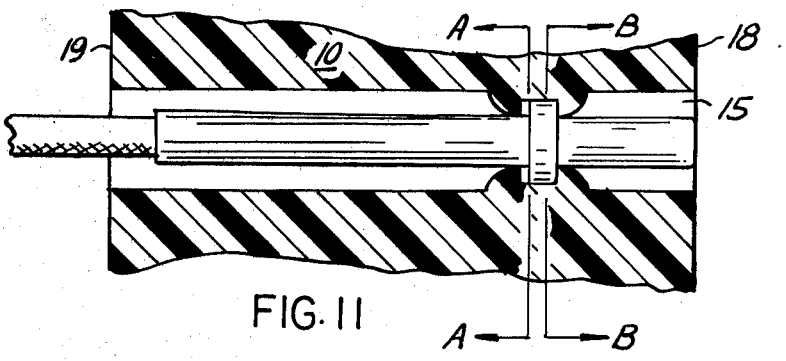
FIG. 11
FIG. 12
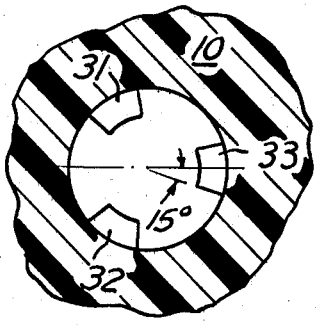
FIG. 13
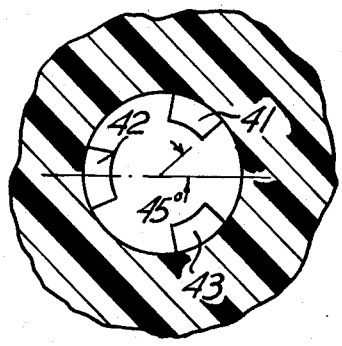

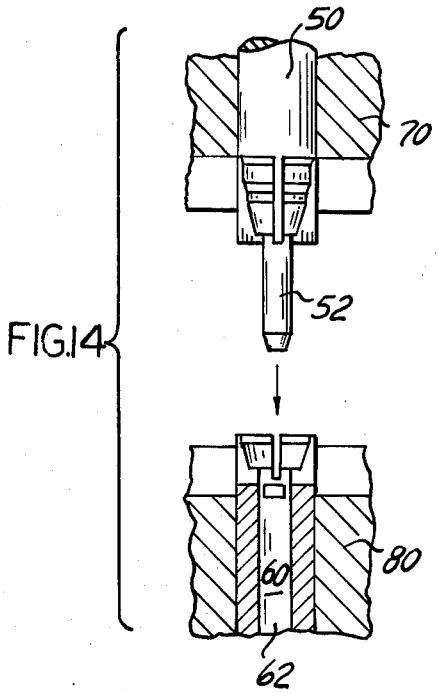
FIG.14
FIG.15
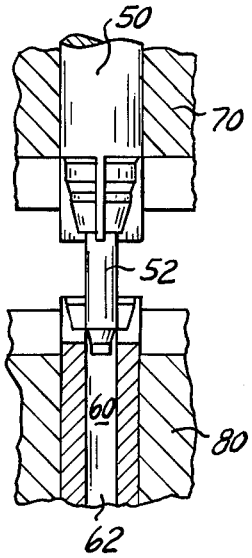
FIG.16
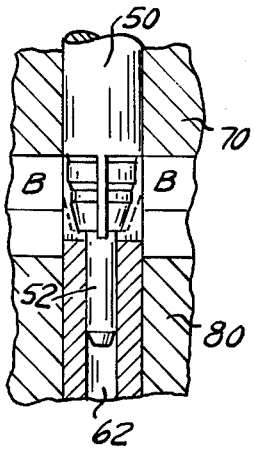
FIG.17
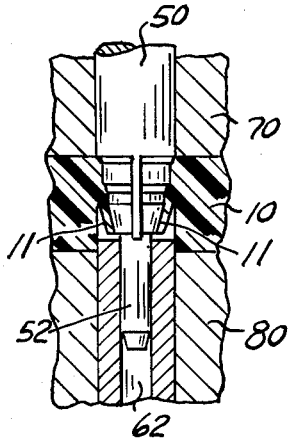
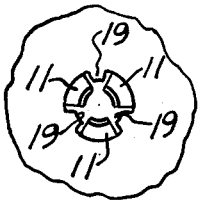
FIG.19
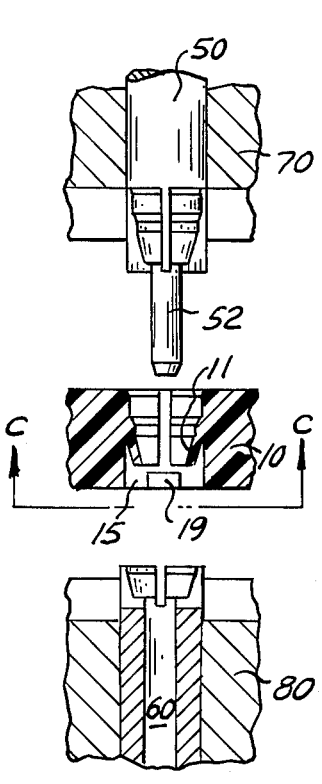
FIG.18

FIG. 20
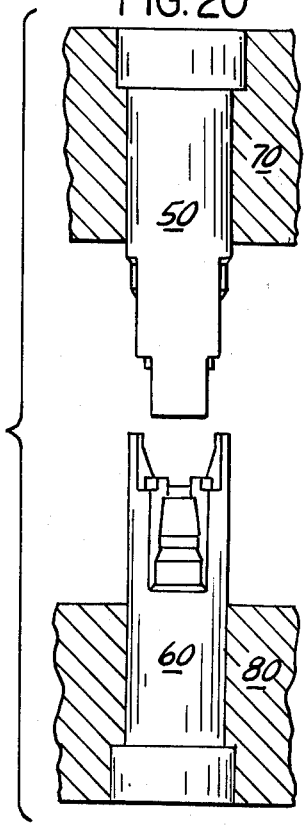
FIG. 21
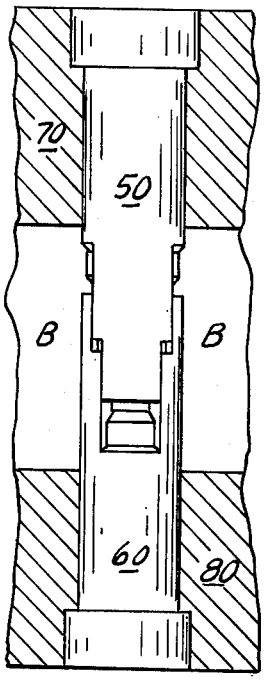
FIG. 22
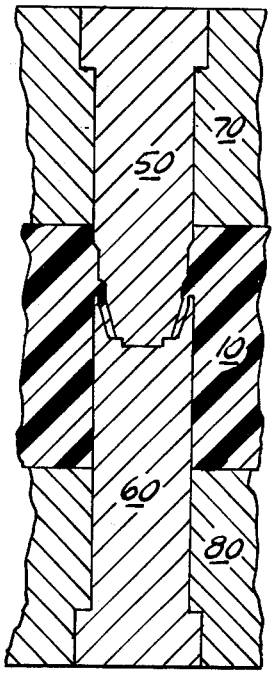
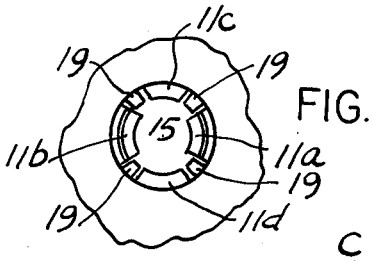
FIG. 24
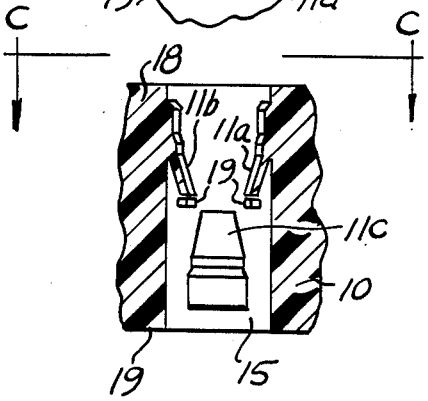
FIG. 23

ELECTRICAL CONNECTOR WITH FRONT AND REAR INSERTABLE AND REMOVABLE CONTACTS

CROSS REFERENCE TO RELATED APPLICATIONS

This application is related to Ser. No. 728,821 entitled "Molded Electrical Connector Insert" filed concurrently with this application on Oct. 1, 1976.

BACKGROUND OF THE INVENTION

This invention relates to electrical connectors of the type having insertable and removable contacts. The invention is more particularly related to the molded contact retaining insert.

Electrical connectors generally include a plug and receptacle, each of which has an insert of dielectric material provided with multiple openings within which electrical contacts are retained. The insert is introduced from the rearward end of the metallic shell where it is held in place by some means, such as a nut. Some connectors provide for rear insertion and release of electrical contacts while others provide for front insertion and release of electrical contacts. These features are desirable and facilitate the assembly and servicing of the connector. Examples of a prior art electrical connector having insertable and removable contacts may be found in U.S. Pat. No. 3,165,369 entitled "Retention System for Electrical Contacts" and issued Jan. 12, 1966 to J. W. Maston; and U.S. Pat. No. 3,221,292 entitled "Electrical Connector" and issued Nov. 30, 1965 to G. J. Swanson et al.

For many years connector manufacturers have been improving and developing means to retain electrical contacts in the electrical connector so that they may be easily inserted and removed with little or no dislocation of contacts upon insertion, removal and mating. However, such development has led to complex and intricate retaining mechanisms which were generally comprised of multiple pieces bonded together. When multiple pieces are used, it is necessary to seal the pieces together to eliminate lower resistance paths between contacts than between the contacts separated by the dielectric material of the insert. The complexity of prior art contact retention mechanisms is exemplified by the electrical connector and insert shown in U.S. Pat. No. 3,727,172 entitled "Electrical Connector" and issued to Kenneth M. Clark on Apr. 10, 1973; and U.S. Pat. No. 3,638,165 entitled "Electrical Connector Contact Retention Assembly" issued Jan. 25, 1972 to J. W. Anhalt et al.

SUMMARY OF THE INVENTION

This invention is an electrical connector 1 that includes an insert 10 having a plurality of bores 15 therethrough, each of the bores having integral therewith a first plurality of radially deflectable contact retention fingers 11 facing an opposing second plurality of radially deflectable contact retention fingers 11. The insert allows an electrical contact 20 to be inserted and removed from either end of the electrical connector.

The invention is an electrical connector insert 10 where an electrical contact may be inserted or removed from either the front or rear end of the connector 1. In one embodiment of the invention, the insert 10 is characterized by a body of molded dielectric material having a plurality of passages 15 therethrough from a front face 18 to a rear face 19, each passage 15 including: a first plurality of truncated tubular contact retention cones or contact retention fingers 11 integral with said body 10 and located within the passage 15, each of the fingers 11 terminating in a free end 12 facing the same direction as one of the insert faces 18; and a second plurality of contact retention fingers 11 integral with said body 10 and located within the passage 15, each of the fingers 11 terminating in a free end 12 facing the direction of the other insert face 19, the free end of the first and second plurality of retention fingers defining a cavity A for releasably retaining the enlarged portion 25 of an electrical contact 20. Each of the fingers 11 being resiliently deflectable radially and substantially rigid in an axial direction when in their nondeflected position.

Accordingly, it is an object of this invention to provide a dielectric insert for an electrical connector which permits electrical contacts to be inserted or removed from either the front or rear of the electrical connector.

It is another object o this invention to provide a simple and economical insert for an electrical connector.

It is still another object of this invention to minimize the number of pieces required to fabricate an electrical connector insert.

The above and other objects and features of the invention will become apparent from the following detailed description taken in conjunction with the accompanying drawings and claims which form a part of this specification. Further, the use of numerals is for the purpose of clarification only and is not intended to limit the structure to the specific structure illustrated.

BRIEF DESCRIPTION OF THE DRAWINGS

FIG. 1 is a partial cross-sectional diagrammatic view of the contact retaining fingers of the electrical connector insert incorporating the principles of the invention.

FIG. 2 is another partial cross-sectional diagrammatic view of the electrical connector insert incorporating the principles of this invention.

FIG. 3 illustrates a cross-sectional view taken along line III—III in FIG. 2.

FIG. 4 illustrates a cross-sectional view taken along line IV—IV in FIG. 2.

FIG. 5 illustrates an alternate embodiment of the invention.

FIG. 10 illustrates an electrical connector assembly incorporating the principles of the invention.

FIG. 11 illustrates an alternate embodiment of the invention.

FIG. 12 is a cross-sectional view taken along line AA in FIG. 11.

FIG. 13 is a cross-sectional view taken along line BB in FIG. 11.

FIGS. 14 through 18 illustrate how one embodiment of the novel insert is molded.

FIG. 19 is an end view of the molded insert taken along line CC in FIG. 18.

FIGS. 20 through 23 illustrate how another embodiment of the novel insert is molded.

FIG. 24 is an end view of a portion of the connector insert taken along line CC of FIG. 24.

DETAILED DESCRIPTION OF THE DRAWINGS

Figure 6:
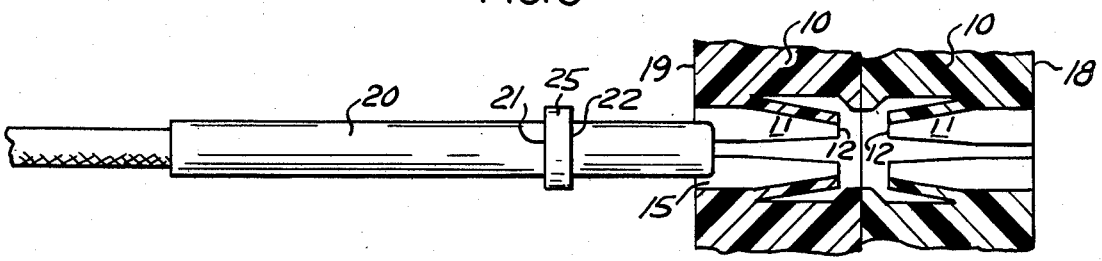
FIGS. 6, 7, 8 and 9 illustrate how an electrical contact may be inserted from one end of the insert and removed from the opposite end.

Referring now to the drawings, FIG. 1 illustrates a portion of an electrical connector insert that illustrates one embodiment of the invention. The insert is comprised of two identical pieces 10, each including a plurality of passages 15 having therein a plurality of radially deflectable contact retention fingers 11 integral with the insert. In this embodiment the fingers 11 are arranged in the shape of a truncated tubular contact retention cone which is resiliently expandable in a radial direction. In prior art contact retention mechanisms, the truncated contact retention cone 11 is not an integral part of the insert but is a wafer held between two inserts. Details of the function and shape of a contact retention cone may be found in U.S. Pat. No. 3,165,369 entitled "Retention System for Electrical Contacts", hereby specifically incorporated by reference. In FIG. 1 a first truncated contact retention cone 11 is located coaxially within each passage 15 and tapers forwardly and radially inwardly from the wall of the passage 15 to a forward free end 12 which terminates a predetermined distance from the free end 12 of a second identical cone 11 facing in the opposite direction. The cones 11 are resiliently radially expandable. Alternately, instead of the specific truncated tubular retention cone shape shown, a plurality of resiliently radially deflectable contact retention fingers may be used. Details of such contact retention fingers and how they operate to retain a contact may be found in U.S. Pat. No. 3,727,172, hereby specifically incorporated by reference.

FIG. 2 is another cross-sectional view of a dielectric insert 10 that includes two truncated tubular contact retention cones 11, each integral with one of the two pieces of the insert 10. The free ends 12 of the cones 11 define a space A, the function of which is to captivate the enlarged portion of an electrical contact (not shown). Annular shoulders 19 aid in centering a contact in the passage.

FIG. 3 illustrates a partial cross-sectional view of the insert 10 taken along line III—III in FIG. 2.

FIG. 4 illustrates a partial cross-sectional view of the insert 10 taken along line IV—IV in FIG. 2.

FIG. 5 illustrates an alternate embodiment of the invention. In this embodiment of the invention, each of the cones are formed from four resiliently deflectable fingers whereas in the preferred embodiment three resiliently deflectable fingers form the truncated tubular contact retention cone 11.

Figure 7:
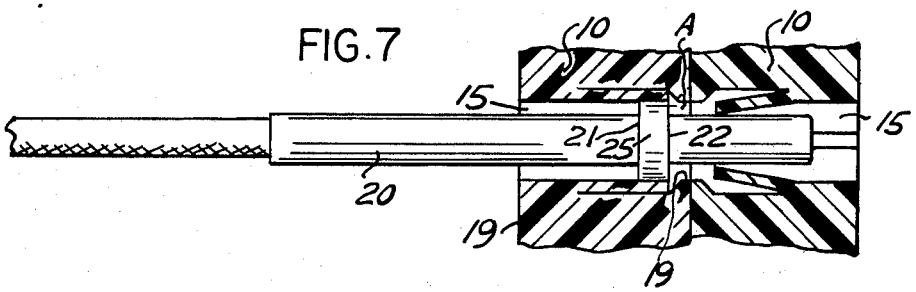
Figure 8:
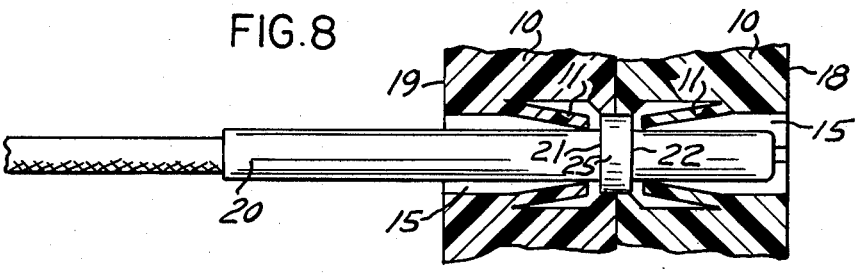

Referring now to FIGS. 6, 7 and 8, an electrical contact is insertable into the insert 10 from either end as follows: The electrical contact 20 is inserted into the passage 15 from one of the faces 19. As the contact proceeds toward the other face 18, the enlarged portion 25 of the contact 20 deflects or expands the retention cone 11 radially outwardly as shown in FIG. 7. This allows the enlarged portion 25 of the contact to proceed into space A. As the enlarged portion 25 of the contact 20 passes the free ends 12 of the contact retention cone 11, the cone contracts behind the contact shoulder 21 to prevent movement of the contact in the passage 15 toward the one face 19. Simultaneously, the other free ends 12 engage the other shoulder 22 to prevent further movement of the contact 20 within the passage 15 toward the other face 18. FIG. 18 illustrates how the shoulders 19 locate the contact 20 in the passage 15 by engaging the enlarged portion 25 of the contact 20.

Figure 9:
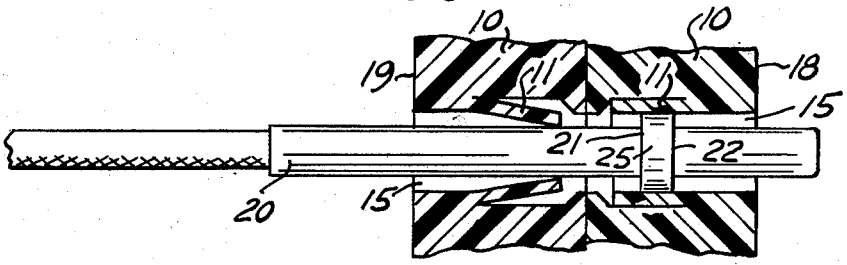

FIG. 9 illustrates how the contact may be removed from the insert by a suitable tool (not shown), inserted into passage 15 to deflect the fingers 11 away from engagement with the shoulder 22 of the contact, allowing the contact to be removed from the insert from either end.

FIG. 10 is one-half of an electrical connector assembly which incorporates the novel dielectric contact retention insert 10. This figure illustrates the simplicity of the electrical connector 1. In this embodiment, the electrical connector includes: a one piece contact retaining insert 10; a plurality of contacts 20 retained by the insert 10; a rear moisture sealing grommet 30; a front moisture sealing grommet 40; a front retaining ring 110; a connector shell 90; a retaining nut 100; and a rear retaining ring 120. Not shown is the other half of the connector assembly which is substantially identical to this half of the connector assembly except for the fact that the connector shell of the other half is mateable with this connector shell 90 and the contacts 20. The other half includes socket type contacts mateable with pin type contacts. This figure illustrates how the electrical contact 20 may be removed from the front or the rear of the connector shell 90. A suitable tool (not shown) is inserted through the passage in either the front grommet 40 or rear grommet 30 and into the insert 10 to deflect the retention fingers 11 and allow the contact 20 to be removed from the connector 1. A wire 3 is connected to each of the contacts 20.

FIGS. 11, 12 and 13 illustrate another embodiment of the invention. In this embodiment an electrical contact is insertable from the rear or front of an electrical connector insert. However, the contacts would not be removable. The molded dielectric material which in this instance may be molded from a single piece includes a plurality of first shoulders 31, 32, 33 integral with the body in the passage 15, each of the shoulders 31, 32, 33 facing in the same direction as one of the insert faces 18. A second plurality of shoulders 41, 42, 43 integral with the body 10 in the passage 15 is arranged so that each of the second shoulders 41, 42, 43 face in the same direction as the other of the insert faces 19. All of the shoulders are resiliently radially deformable while being substantially rigid in the axial direction so that a contact may be forced into the space defined by the two pluralities of shoulders.

Although the shoulders may be in the form of a single annular ring having a shoulder facing in a particular direction, the embodiment shown illustrates that each of the forward facing shoulders 31, 32, 33 and the rear of the facing shoulders 41, 42, 43 are comprised of arcuate segments approximately 30 radial degrees. The forwardly facing shoulders 31, 32, 33 are rotated approximately 45° from the axis of the rearwardly facing shoulders 41, 42, 43. This arrangement allows the insert 10 to be molded from one piece as opposed to being comprised of two identical pieces having a single annular ring of deformable dielectric material.

FIGS. 14 through 18 illustrate how one embodiment of the novel dielectric contact retaining insert 10 is molded. Generally, the dielectric retention insert is made from a thermal, plastic resin, although other materials such as thermal setting materials may be used. Some examples of preferable materials are: polyester (valox); polyarylsulfone (B360 Astrel); polyethersulfone (torlon); polymides (nylon); acetates (deldrin); and polycarbonates (lexan). The polyester material sold under the trade name Valox is preferred along with polyarylsulfones and polyethersulfones. The foregoing materials have acceptable mechanical strength and electrical insulation characteristics which serve to increase the dielectric separation between adjacent contacts.

FIG. 14 illustrates a portion of one half of the mold 70 having a plurality of core pins 50 mounted therein and a portion of the other half of the mold 80 having a plurality of core bushings mounted therein. The core pin 50 includes an axially extending projection 52 which mates with an axial passageway 62 in the bushing 60 in the other half 80 of the mold.

FIG. 15 illustrates how the axial projection 52 of a core pin 50 in one half of a mold 70 mates with the passageway 62 in core bushing 60 located in the other half 80 of the mold.

FIG. 16 illustrates a core pin 50 and a core bushing 60 in the fully mated position as well as the two halves 70 and 80 of the mold joined together to form a molding cavity B into which a thermal plastic material in liquid form is poured and allowed to harden. The mold cavity B includes a plurality of mated core pins and bushings to form a molded contact retaining insert capable of retaining a plurality of electrical contracts (not shown). The mold, of course, has the appropriate means, such as passageways through the upper half of the mold 70 into cavity B, for filling and venting cavity B.

FIG. 17 illustrates a completely molded contact retention insert 10 which includes integral therewith contact retaining fingers 11. The portion of the passage 15 in the cone portion of the insert 10 takes on a configuration of the core pin 50.

FIG. 18 illustrates the two halves 70 and 80 of the mold separated and a portion of the insert 10 which was formed in the mold cavity. This figure illustrates the location of the radial shoulder 19 which functions to center the contact in the passageway 15 of the insert 10. This is accomplished by the radial shoulder 19 engaging the enlarged portion 25 (not shown) of the contact.

FIG. 19 illustrates the contact retaining fingers 11 and radial shoulder 19 looking along line CC of the insert 10 shown in FIG. 18. This end view illustrates that in this embodiment there are three radial shoulders 19 for engaging the enlarged portion of a contact and centering the contact, and there are three contact retaining fingers 11 for engaging one of the shoulders of the enlarged portion of the contact to prevent movement of the contact once located in the insert. In this embodiment the insert for retaining contacts that may be inserted or removed from either end of a connector is comprised of two identical pieces. The identical pieces would be bonded together in face to face relationship so that the fingers 11 oppose each other as shown in FIG. 8.

FIGS. 20 through 23 illustrate how another embodiment of the novel insert is molded. In the embodiment shown in these figures the insert to be molded will be comprised of a single unitary structure as opposed to the embodiment shown in FIGS. 14 through 18 which was comprised of two identical pieces bonded together in face to face relationship.

FIG. 20 illustrates a portion of one half of the mold 70 having a plurality of core pins 50 mounted therein and a portion of the other half of the mold 80 having a plurality of core bushings 60 mounted therein.

FIG. 21 illustrates the core pin 50 and the core bushing 60 in the fully mated position as well as the two halves 70 and 80 of the mold arranged to form a molding cavity B into which thermal plastic material in liquid form is received and allowed to harden. The mold cavity B includes a plurality of mated core pins and bushings, only one of each is shown, to form a molded contact retaining insert capable of retaining a plurality of electrical contacts (not shown). The mold, of course, has the appropriate means, such as passageways, through the upper half of the mold 70 into cavity B, for filling and venting the cavity B.

FIG. 22 illustrates a completely molded contact retention insert 10 which is a one piece unitary structure. The insert 10 includes integral therewith contact retaining fingers 11. The portion of the passage 15 in the core portion of the insert 10 takes on the configuration of the void formed between the core pin 50 and core bushing 60.

FIG. 23 illustrates the one piece molded dielectric insert which was formed in mold cavity B. The insert includes two pairs of retaining fingers 11. One pair of contact retaining fingers 11*a* and 11*b* project toward one face 18 of the insert while the other pair 11*c* (11*d* not shown) face the direction of the other face 19 of the insert.

FIG. 24 illustrates an end view of a portion of the insert 10 taken along lines CC in FIG. 24. This view illustrates the orientation of the four retaining fingers 11 and the four shoulders 19 that engaged the enlarged portion of a contact (not shown) to center the contact in the insert passage 15 (e.g. see FIG. 8).

While a preferred embodiment of the invention has been disclosed, it will be apparent to those skilled in the art that changes may be made to the invention as set forth in the appended claims and, in some instances, certain features of the invention may be used to advantage without corresponding use of other features. For example, it was pointed out that the ribs 16 could be replaced by an annular shoulder 31 located in the passage 15 of the insert 10. Additionally, the position of the contact retention cone and ribs may be reversed depending on whether or not forward or rearward insertable contact electrical connector is desired. By arranging the insert 10 in an electrical connector with the free end of the truncated contact retention cone facing toward the front of the connector or the rear of the connector, the connector would receive electrical contacts from the rear or front, respectively. It is to be understood that, like the prior art fingers, the cone or fingers 11, although radially deflectable, are generally rigid in an axial direction when in their contracted position so as to provide a positive stop against rearward movement of an electrical contact. Accordingly, it is intended that the illustrative and descriptive materials herein be used to illustrate the principles of the invention and not to limit the scope thereof.

Having described the invention, what is claimed is:

1. An electrical connector insert for receiving and retaining a plurality of elongated electrical contacts, each contact having an enlarged section defining two shoulders that face in opposite directions, said insert comprising:

a body of molded dielectric material having a plurality of passages therethrough from a front face to a rear face, the cross-section of each passage throughout the length of the passage being at least as large as the enlarged section of a contact, each passage adapted to receive a respective electrical contact therein which is insertable from the rear face of said contact, each passage including:

a first truncated tubular contact retention cone integral with said body and located coaxially within said passage, said cone normally in a contracted configuration and resiliently radially deformable to permit the enlarged section of a contact to pass therethrough upon insertion tapering rearwardly and radially inwardly from the wall of said passage to a forward free end, said free end adapted to engage one of said contact shoulders when said contact is inserted into said insert from the rear face, said first cone being substantially rigid in an axial direction in the contracted configuration;

a second truncated tubular contact retention cone integral with said body and located coaxially within said passage, said second cone tapering forwardly and radially inwardly from the wall of said passage to a forward free end which terminates a predetermined distance from the free end of said first retention cone, said free end of said second retention cone adapted to engage the other of said contact shoulders when said contact is inserted into said insert from said rear face of said inserts, said second cone being resiliently radially expandable to permit the enlarged section of a contact to pass therethrough upon insertion of the contact into said passage from the rear face of said insert, said second cone contracting behind the other of said contact shoulders to limit rearward movement of the contact in the passage, said second cone being substantially rigid in an axial direction when in its contracted position so as to provide a positive stop against rearward movement of an electrical contact, whereby the enlarged portion of a contact inserted into said passage is captivated between the free end of said first retention cone and the free end of said second retention cone.

2. An electrical connector insert for receiving and retaining a plurality of elongated electrical contacts, each contact having an enlarged section defining two shoulders that face in opposite directions, said insert comprising:

a body of molded dielectric material having a plurality of passages therethrough from a front face to a rear face, each passage adapted to receive a respective electrical contact therein which is insertable from the front face of said insert, each passage large enough to allow a contact to pass therethrough including:

a first truncated tubular contact retention cone integral with said body and located coaxially within said passage, said cone adapted to be resiliently radially deformable to allow the entire contact to pass therethrough when radially deformed and when not radially deformed tapering forwardly and radially inwardly from the wall of said passage to a forward free end adapted to engage one of said contact shoulders when said contact is inserted into said insert from said front face; and a second truncated tubular contact retention cone integral with said body and located coaxially within said passage, said second cone tapering rearwardly and radially inwardly from the wall of said passage to a forward free end which terminates a predetermined distance from the free end of said first contact retention cone, said free end of said second contact retention cone adapted to engage the other of said contact shoulders when said contact is inserted into said insert from the front face of said insert, said second cone being resiliently radially expandable to permit the enlarged section of a contact to pass therethrough upon insertion of the contact into said passage from the front face of said insert, said second cone contracting behind the other of said contact shoulders to limit forward movement of the contact in the passage, said second cone being substantially rigid in an axial direction when in its contracted position so as to provide a positive stop against forward movement of an electrical contact, said second cone being resiliently radially deformable to allow the entire contact to pass therethrough when radially expanded, whereby the enlarged portion of a contact inserted into said passage is captivated between the free end of said first retention cone and the free end of said second retention cone and whereby the contact may be removed from captivation between the free ends of the cones by radially deforming either said first or said second cone.

3. An electrical connector insert comprising:

a body of molded dielectric material having a plurality of passages therethrough from a front face to a rear face for receiving a contact, each passage including a first portion deformable to a size at least large enough to allow the entire contact to pass therethrough, and the remaining portion of said passage through its length at least large enough to allow the entire contact to pass therethrough, including:

a first truncated tubular cone integral with said body and located coaxially within said passage, said cone tapering toward one of said insert faces radially inwardly from the wall of said passage to a forward free end; and a second truncated tubular cone integral with said body and located coaxially within said passage, said second cone tapering toward the other of said insert faces radially inwardly from the wall of said passage to a foward free end which terminates a predetermined distance from the free end of said first tubular cone, said first and second cones being resiliently deformable to at least large enough to allow the contact to pass therethrough and substantially rigid in a size less than large enough to allow the contact to pass therethrough in an axial direction when in their nonexpanded position.

4. An electrical connector comprising:

a one-piece unitary body of molded dielectric material having a plurality of passages therethrough from one face to another face, each passage including:

a plurality of first shoulders integral with said body in said passage wall, each of said shoulders facing the same direction as one of said insert faces, said plurality of shoulders being resiliently radially deformable and accessible from the other face for radial deformation by a tool to allow an electrical contact to pass therethrough and substantially rigid in an axial direction when in their nondeformed state; and a plurality of second shoulders integral with said body in said passage wall, each of said second shoulders facing in the same direction as the other of said insert faces and facing said plurality of first shoulders at a predetermined distance, said second plurality of shoulders being resiliently radially deformable and accessible from the one face for radial deformation by a tool to allow an electrical contact to pass therethrough and substantially rigid in an axial direction when in their nondeformed position.

5. An electrical connector insert for receiving and retaining a plurality of elongated electrical contacts, each contact having an enlarged section defining two shoulders that face in opposite directions, said insert comprising:

a one-piece unitary body of molded dielectric material having a plurality of passages therethrough from one face to another face, each passage adapted to receive a respective electrical contact therein which is insertable from one of said insert faces, each passage including:

a first shoulder integral with said body in said passage wall, said first shoulder facing in the same direction as one of said insert faces and adapted to engage one of said contact shoulders when said contact is inserted into said insert, said first shoulder resiliently radially deformable to permit the enlarged section of a contact to pass therethrough for insertion of a contact, said first shoulder returning to its nondeformed position behind a contact shoulder to limit movement of the contact in said passage with said first shoulder being resiliently radially deformable by the insertion of an appropriate tool from the other insert face for releasing the contact; and a second shoulder integral with said body in said passage wall, said second shoulder facing in the same direction as the other of said insert faces and facing said first shoulder at a predetermined distance, said second shoulder adapted to engage the other of said contact shoulders when said contact is inserted into said insert from one of said insert faces, said second shoulder being resiliently radially deformable to permit the enlarged section of a contact to pass therethrough upon insertion of the contact into said passage from one of said insert faces, said second shoulder being resiliently radially deformable upon insertion of the tool from the one face the second shoulder returning to its original nondeformed position behind the other of said contact shoulders to limit movement of the contact in the passage when neither the enlarged contact section nor the tool deform the shoulder, said second shoulder being substantially rigid in an axial direction when in its nondeformed position so as to provide a positive stop against movement of an electrical contact, whereby the enlarged portion of said contact inserted into said passage is captivated between said first and second shoulders and whereby the contact may be inserted or removed from either face of said body.

6. An electrical connector insert for receiving and retaining a plurality of elongated electrical contacts, each contact having an enlarged section defining two shoulders that face in opposite directions, said insert comprising:

a one piece unitary body of molded dielectric material having a plurality of passages therethrough from a front face to a rear face, each passage adapted to receive a respective electrical contact therein which is insertable from one of the faces of said insert, each passage including:

a first plurality of radially-deflectable resilient contact retention fingers integral with said body and located within said passage, said fingers extending rearwardly and radially inwardly from the wall of said passage to a forward free end adapted to engage one of said contact shoulders when said contact is inserted into said insert from one of said faces;

a second plurality of radially-deflectable resilient contact retention fingers integral with said body and located within said passage, said second plurality of fingers extending forwardly and radially inwardly from the wall of said passage to a forward free end which terminates a predetermined distance from the free end of said first plurality of fingers, the free end of said second plurality of fingers adapted to engage the other of said contact shoulders when said contact is inserted into said insert from one of said faces, each of said fingers of said second plurality of fingers being resiliently deflectable radially to permit the enlarged section of a respective contact to pass the free ends thereof upon insertion of the contact into said passage from one of said faces, said second plurality of fingers returning to their origianl position behind the other of said contact shoulders to prevent removal of the contact in the passage, each of said fingers of said second plurality of fingers being substantially rigid in an axial direction when in their nondeflected position so as to provide a positive stop against removal of an electrical contact and a radial projection in the passage for engaging the enlarged section of the contact, the radial projection being an annular segment located between the free ends of the first and second plurality of fingers, whereby the enlarged portion of a contact inserted into said passage is captivated between the free ends of said first and second plurality of fingers.

7. An electrical connector insert for receiving and retaining a plurality of elongated electrical contacts, each contact having an enlarged section defining two shoulders that face in opposite directions, said insert comprising:

a body of molded dielectric material having a plurality of passages therethrough from a front face to a rear face, each passage adapted to receive a respective electrical contact therein which is insertable from either one of the faces of said insert, each passage having throughout its length a cross-section at least as large as a dimension of the contact, each passage including:

a first plurality of radially-deflectable resilient contact retention fingers integral with said body and located within said passage, said fingers extending rearwardly and radially inwardly from the wall of said passage to a forward free end adapted to engage one of said contact shoulders when said contact is inserted into said insert from one of said faces;

a second plurality of radially-deflectable resilient contact retention fingers integral with said body and located within said passage, said second plurality of fingers extending forwardly and radially inwardly from the wall of said passage to a forward free end which terminates a predetermined distance from the free end of said first plurality of fingers, the free end of said second plurality of fingers adapted to engage the other of said contact shoulders when said contact is inserted into said insert from one of said faces, each of said fingers of said second plurality of fingers being resiliently deflectable radially to permit the enlarged section of a respective contact to pass the free ends thereof upon insertion of the contact into said passage from one of said faces, said second plurality of fingers returning to their original position behind the other of said contact shoulders to prevent removal of the contact in the passage, each of said fingers of said second plurality of fingers being substantially rigid in an axial direction when in their nondeflected position so as to provide a positive stop against removal of an electrical contact, whereby the enlarged portion of a contact inserted into said passage is captivated between the free ends of said first and second plurality of fingers.

8. The electrical connector insert as recited in claim 7 wherein the body of molded dielectric material is comprised of a one piece unitary structure.

9. An electrical connector insert as recited in claim 8 wherein the body of molded dielectric material includes:

a radial projection in the passage for engaging the enlarged section of the contact, the radial projection being an annular segment located between the free ends of the first plurality and second plurality of contact retention fingers.

10. An electrical connector insert comprising:

a body of molded dielectric material having a plurality of passages therethrough from a front face to a rear face, each passage including:

a first plurality of contact retention fingers integral with said body and located within said passage, each of said fingers resiliently radially deflectable and substantially rigid in an axial direction when in its nondeflected position terminating in a free end facing in the same direction as one of said insert faces; and a second plurality of contact retention fingers integral with said body and located within said passage, each of said fingers terminating in a free end facing in the same direction as the other of said insert faces, the free end of said second plurality of retention fingers terminating a predetermined distance from the free end of said first plurality of retention fingers, each of said fingers being resiliently deflectable radially and substantially rigid in an axial direction when in its nondeflected position, with each of said first and second plurality of fingers being resiliently deflectable by a tool inserted within the passage adapted for releasing a contact held between said first and second plurality of fingers for removal from the body, whereby a contact may be inserted or removed from either front or rear face.

11. The insert recited in claim 10 wherein said body is comprised of two identical pieces arranged in face to face relationship, one of said pieces including said first plurality of contact retention fingers and the other of said pieces including said second plurality of contact retention fingers.

12. The insert recited in claim 10 wherein said body is comprised of a one piece unitary structure.

* * * * *